US011761266B1

(12) United States Patent
Shalouf

(10) Patent No.: US 11,761,266 B1
(45) Date of Patent: Sep. 19, 2023

(54) OIL RIG MAST HOISTING SYSTEM

(71) Applicant: SAUDI ARABIAN OIL COMPANY, Dhahran (SA)

(72) Inventor: Fathalla Shalouf, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/823,820

(22) Filed: Aug. 31, 2022

(51) Int. Cl.
*E21B 15/00* (2006.01)
*E21B 7/02* (2006.01)

(52) U.S. Cl.
CPC ..... *E21B 15/00* (2013.01); *E21B 7/023* (2013.01)

(58) Field of Classification Search
CPC . E21B 7/02; E21B 7/023; E21B 15/00; E21B 15/045; E21B 15/04; E21B 15/02; E21B 15/006; E21B 15/003; E21B 7/021; E21B 7/022; B66C 23/34; B66C 13/18
See application file for complete search history.

(56) References Cited

U.S. PATENT DOCUMENTS 4,334,217 A 6/1982 Nield et al.
4,348,907 A * 9/1982 Giese ..... G01L 5/047 73/862.392
4,545,017 A 10/1985 Richardson
4,787,244 A 11/1988 Mikolajczyk
10,550,640 B2 2/2020 Orban et al.
2009/0200856 A1 8/2009 Chehade et al.
2013/0129452 A1* 5/2013 Vehmeijer ..... F16L 1/207 414/803
2014/0019016 A1* 1/2014 Miyoshi ..... B66C 23/905 701/50
2019/0031474 A1* 1/2019 Stilborn ..... B66D 1/56
2019/0360311 A1* 11/2019 Camacho Cardenas ..... G01C 19/00
2020/0048965 A1* 2/2020 Chen ..... E21B 7/02
2021/0054645 A1* 2/2021 Shalouf ..... E21B 15/006
2022/0219953 A1* 7/2022 Tanii ..... B66C 13/46

* cited by examiner

*Primary Examiner* — Kipp C Wallace
(74) *Attorney, Agent, or Firm* — Osha Bergman Watanabe & Burton LLP

(57) ABSTRACT

A system includes hoisting cables for raising or lowering an oil rig mast, a support, and hoisting sheaves rotatably mounted on the support. The hoisting cables are wound at least in part about the hoisting sheaves during a process of raising or lowering the mast. Also included are measurement devices which measure angular displacement of the hoisting sheaves during a process of raising or lowering the mast with the hoisting cables. Further included is a signaling device which produces a signal if the measured angular displacement of the hoisting sheaves does not correspond to one or more reference values. A related method includes measuring angular displacement of the hoisting sheaves; comparing measured angular displacement of the hoisting sheaves with one or more reference values; and producing a signal if the measured angular displacement of the hoisting sheaves does not correspond to the one or more reference values.

19 Claims, 4 Drawing Sheets

OIL RIG MAST HOISTING SYSTEM

BACKGROUND

An oil rig, as referred to herein, can be understood as an integrated system for performing various operations such as sampling subsurface mineral deposits, testing physical properties of the deposits, and installing subsurface fabrications which may include underground tunnels and utilities. Oil rigs often include a mast disposed on a substructure and a hoisting assembly coupled to the mast via wires for raising or lowering operations of the mast.

The mast may be understood as a structural tower including one or more sections are assembled on the ground at a predetermined location for the oil rig on the terrestrial surface. After the mast is assembled, it is then normally raised to an operating position via a hoisting system and cables coupling the mast to the hoisting system. The mast stays raised and intact while drilling operations are carried out via related equipment.

The hoisting system normally includes one or more sheaves (or pulleys) about which one or more hoisting cables are run. As it is often difficult to ascertain movement of the sheaves during an operation of raising the mast, a host of problems may result if irregular movement of the sheaves is left unchecked. For instance, the mast may fail to properly level, loads may be distributed unevenly throughout the mast structure, and one or more hoisting cables may experience the phenomenon of "birdcaging," where outer strands of the cable may become distorted or splayed and separate from the core of the cable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method including: attaching hoisting cables to an oil rig mast; winding the hoisting cables at least in part about hoisting sheaves rotatably mounted on a support; effecting angular displacement of the mast with the hoisting cables in a process of raising or lowering the mast; measuring angular displacement of the hoisting sheaves; comparing measured angular displacement of the hoisting sheaves with one or more reference values; and producing a signal if the measured angular displacement of the hoisting sheaves does not correspond to the one or more reference values.

In one aspect, embodiments disclosed herein relate to a system including hoisting cables for raising or lowering an oil rig mast, a support, and hoisting sheaves rotatably mounted on the support. The hoisting cables are wound at least in part about the hoisting sheaves during a process of raising or lowering the mast. Also included are measurement devices which measure angular displacement of the hoisting sheaves during a process of raising or lowering the mast with the hoisting cables. Further included is a signaling device which produces a signal if the measured angular displacement of the hoisting sheaves does not correspond to one or more reference values.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements. In accordance with one or more embodiments, an arrangement is provided, for a hoisting system for an oil rig mast, to ensure that the hoisting sheaves are able to rotate in a controlled and steady manner and to help prevent or mitigate what otherwise may amount to significant ancillary structural issues. To this end, an arrangement may be provided for each of sheaves to track their movement and issue a signal if they are not moving in accordance with a predetermined manner.

Figure 1:
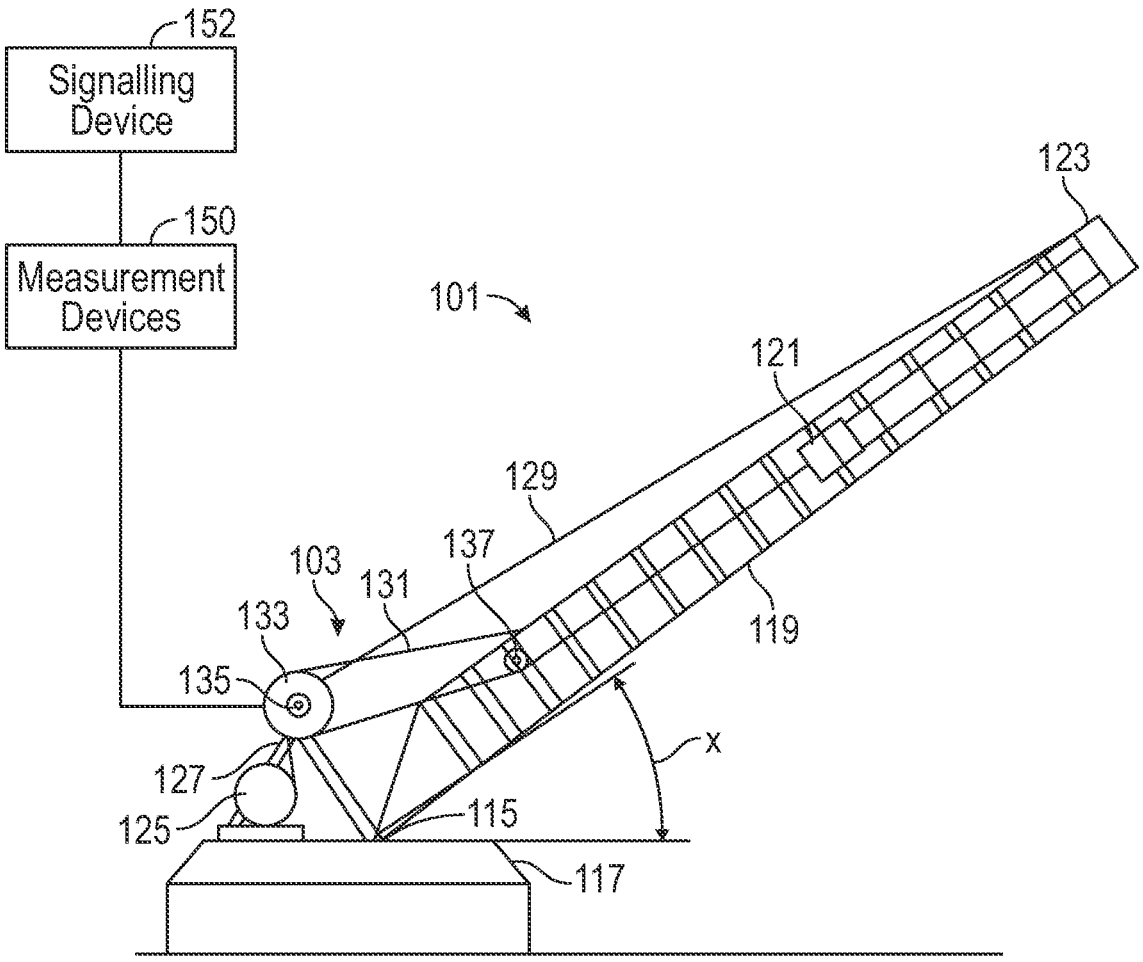
FIG. 1 schematically illustrates, in elevational view, a portion of an oil rig installed at a rig site while in a process of raising or lowering a mast.

In accordance with one or more embodiments, FIG. 1 schematically illustrates, in elevational view, a portion of an oil rig 101 installed at a rig site while in a process of raising or lowering a mast 119. Accordingly, the oil rig 101 may include a substructure 117 which supports the mast 119, a pulley system 103 at the mast 119, and other drilling equipment (not shown). The mast 119 may be coupled to the substructure 117 via a pivot joint 115. By rotating the mast 119 about the pivot joint 115 using the pulley system 103, the mast 119 may be raised to a vertical orientation for rig operations or lowered to a substantially horizontal orientation for stowing away.

In accordance with one or more embodiments, a mast system includes mast 119, a traveling block 121, a crown block 123, a drawworks 125 disposed under a support 127 (which may be in the form of an A-frame support as shown), and one or more drilling cables 129 at least partly wound about the drawworks 125. Pulley system 103 includes the drilling cables 129 and hoisting cables 131; for illustrative purposes, there may be two each of drilling cables 129 and hoisting cables 131. Drilling cables 129 pass through a location at crown block 123 and extend further to traveling block 121, where the traveling block 121 couples the drilling cables 129 and hoisting cables 131 at an interior portion of mast 119. Thus, the hoisting cables 131 are anchored at the mast 119 at one end while the other end is coupled to the traveling block 121.

In accordance with one or more embodiments, pulley system 103 includes one or more hoisting sheaves 133, e.g., of which there may be two rotatably mounted at opposite sides of support 127. Each of the hoisting cables 131 thus may be wound at least in part about a corresponding one of the hoisting sheaves 133. Additionally, pulley system may include one or more drilling sheaves 135, about which the drilling cables 129 are wound at least in part. Drilling sheaves 135 may be rotatably mounted on support 127, and concentric with respect to hoisting sheaves 133 as shown. Furthermore, a pair of side sheaves 137 may be disposed at opposite sides of the mast 119 to guide movement of the hoisting cables 131. Particularly, the use of side sheaves 137 helps provide additional structural integrity during a hoisting operation when the drawworks 125 may be pulling the drilling cable 129 that is coupled to the hoisting cables 131 at the at the traveling block 121.

In accordance with one or more embodiments, as is also shown in FIG. 1, the drilling cables 129 are anchored at the drawworks 125 at one end while the other end is coupled to the hoisting cables 131 at the traveling block 121 after passing through the location at the crown block 123 on the mast 119. During such raising operations, the movement of the drilling cable 129 is guided by the drilling sheaves 135 and the movement of the hoisting cables 131 is guided by the hoisting sheaves 133 on the sides of the support 127 and the side sheaves 137 on the mast 119.

Figure 2:
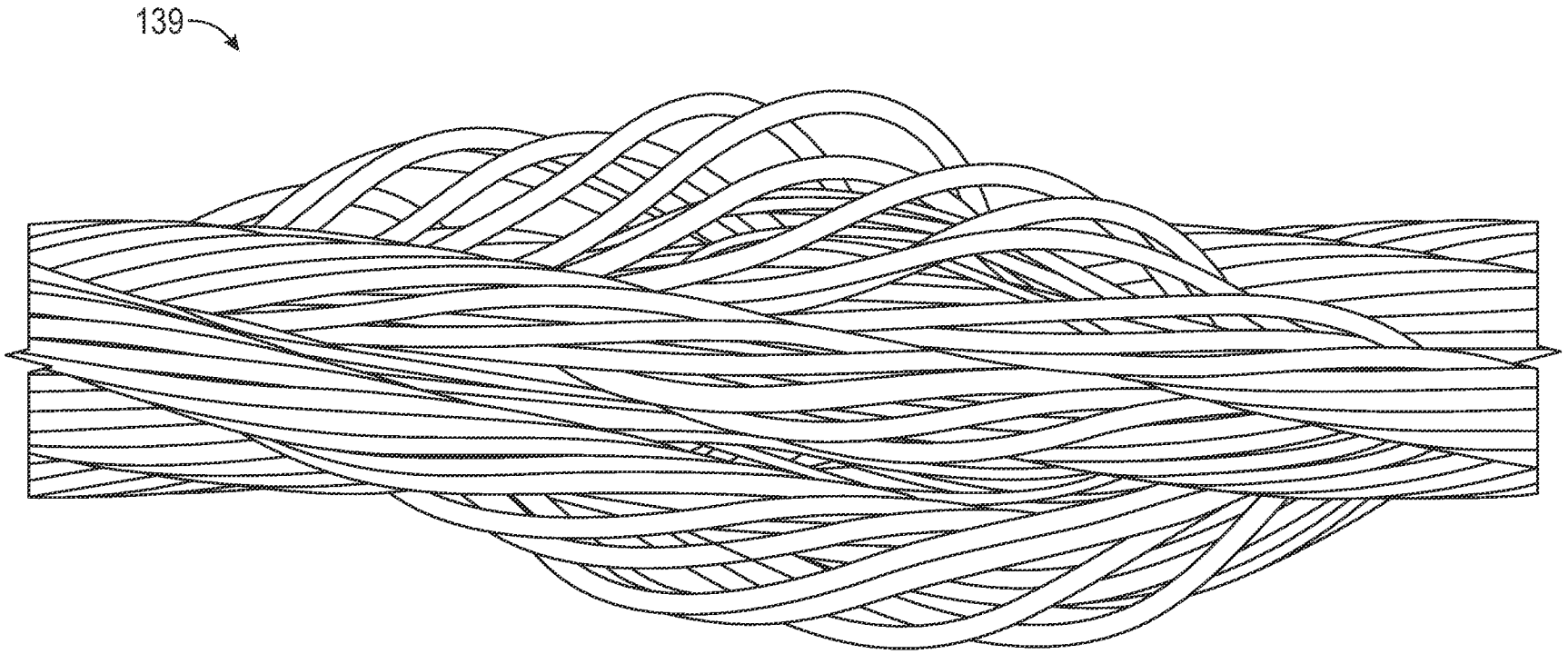
FIG. 2 illustrates a portion of a hoisting cable subjected to birdcaging.

In accordance with one or more embodiments, it is recognized that there is a correlation between a change in angular displacement of the mast 119 (via a change in its angle of inclination X) and angular or rotational displacement of the hoisting sheaves 133. For instance, in one illustrative example, if hoisting sheaves 133 are understood to rotate one time, i.e., 360 degrees, to change the position of the mast 119 from horizontal to vertical during a hoisting process, the angle X will increase from 0 to 90 degrees such that 4 degrees of angular displacement of the hoisting sheaves 133 corresponds to one degree of angular displacement of mast 119. If one or more of the hoisting sheaves 133 is arrested or slowed in movement (e.g., via becoming stuck while rotating) then the correlation between angular displacement of the hoisting sheaves 133 and that of the mast 119 may well change. This may then result in a change in the position or orientation of mast 119, such as a difference between levels of a driller side and an off-driller side of mast 119. In turn, this may generate undesired additional stresses in various structural members of the mast 119, while also possibly causing an undesired imbalance in the distribution of stresses. This may also cause birdcaging of one or more of the hoisting cables 131. For merely illustrative purposes, FIG. 2 shows a portion 139 of a hoisting cable subjected to birdcaging.

Returning to FIG. 1, in accordance with one or more embodiments, it can be appreciated that if stresses in any portion of the mast 119 exceed a safe or rated limit, individual segments may deflect or buckle, possibly causing premature structural failure of the entire mast 119. At the same time, if one or more of the hoisting cables 131 do experience birdcaging, tensile loads from the raising or lowering process will be concentrated in fewer and fewer strands of the cables. Thus, this could cause premature structural failure or rupturing of the hoisting cables 131 themselves, causing the mast 119 to fall down.

Accordingly, as shown in FIG. 1, one or more measurement devices 150 may be provided to obtain reliable, constant or periodic measurements of the rotational displacement of the hoisting sheaves 133. In one illustrative implementation, one such measurement device 150 may be provided for each of the sheaves. The measurement devices 150 may be in direct or indirect communication with a computer processor, such as processor 805 of computer 802 shown in FIG. 4. Via such a computer processor, measurements of rotational displacement may be compared with reference values. A warning signal may then be produced may be produced via a signaling device 152 if any measured value is determined to lie outside a predetermined range. Thus, this can serve as an early warning to stop the raising or lowering operation and check the hoisting sheaves 133, and repair the same if warranted. The measurement devices 150 may take essentially any suitable form; by way of illustrative example, they may be embodied by laser-based measurement devices. The warning signal may take essentially any suitable form, such as an auditory signal (e.g., "beeps" or other distinct auditory pattern), a visual signal (e.g., one or more flashing lights) or even an alert or notification sent as a text or pre-generated message to a computer, phone or other mobile device.

Figure 3:
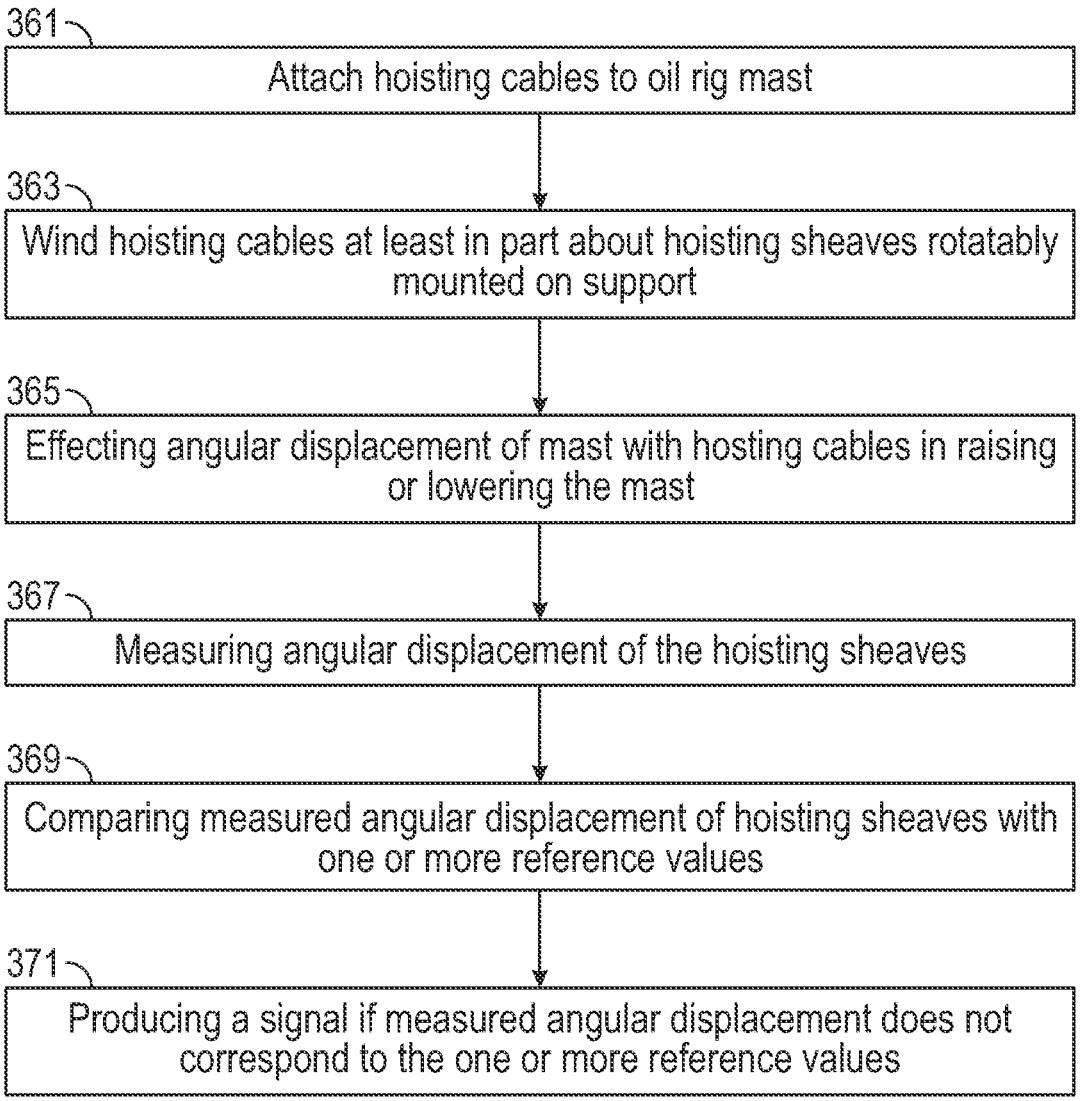
FIG. 3 shows a flowchart of a method in accordance with one or more embodiments.

In accordance with one or more embodiments, rotational (or angular) displacement of each of the hoisting sheaves 133 (during a raising or lowering process of mast 119) may be tracked against a separately measured inclination angle X of the mast 119. To that end, essentially any suitable mechanism may be used toward such measurement of the mast 119. If a metric such as the ratio of a described rotational displacement of one or more of the hoisting sheaves 133 to a described angular displacement of mast 119 falls outside of a predetermined acceptable range, then a signal may be produced by signaling device 152 as noted above. In a conceivable alternative implementation, rotational displacement of each of the hoisting sheaves 133 may be tracked against time, with a signal produced by signaling device 152 if the temporal rate of change of angular displacement of one or more hoisting sheaves 133 falls outside of a predetermined acceptable range FIG. 3 shows a flowchart of a method, as a general overview of steps which may be carried out in accordance with one or more embodiments described or contemplated herein.

As such, in accordance with one or more embodiments, hoisting cables are attached to an oil rig mast (361). As an example, this may correspond to the cables 131 and mast 119 described and illustrated with respect to FIG. 1. The hoisting cables are wound at least in part about hoisting sheaves rotatably mounted on a support (363). The hoisting sheaves and support may correspond, by way of example, to those components indicated at 133 and 127, respectively, in FIG. 1. Angular displacement of the mast is effected with the hoisting cables, in a process of raising or lowering the mast (365). This may correspond to the process of raising/lowering described and illustrated with respect to FIG. 1, by way of an illustrative example. Angular displacement of the hoisting sheaves is measured (367). By way of example, this may be carried out by a measurement devices 150 as described and illustrated with respect to FIG. 1. The measured angular displacement of the hoisting sheaves is compared with one or more reference values (369). As an example, this may be undertaken in a manner such as that described with respect to FIG. 1. A signal is produced if the measured angular displacement of the hoisting sheaves does not correspond to the one or more reference values (371). By way of example, this may be undertaken by a signaling device 152 such as that shown in FIG. 1.

Figure 4:
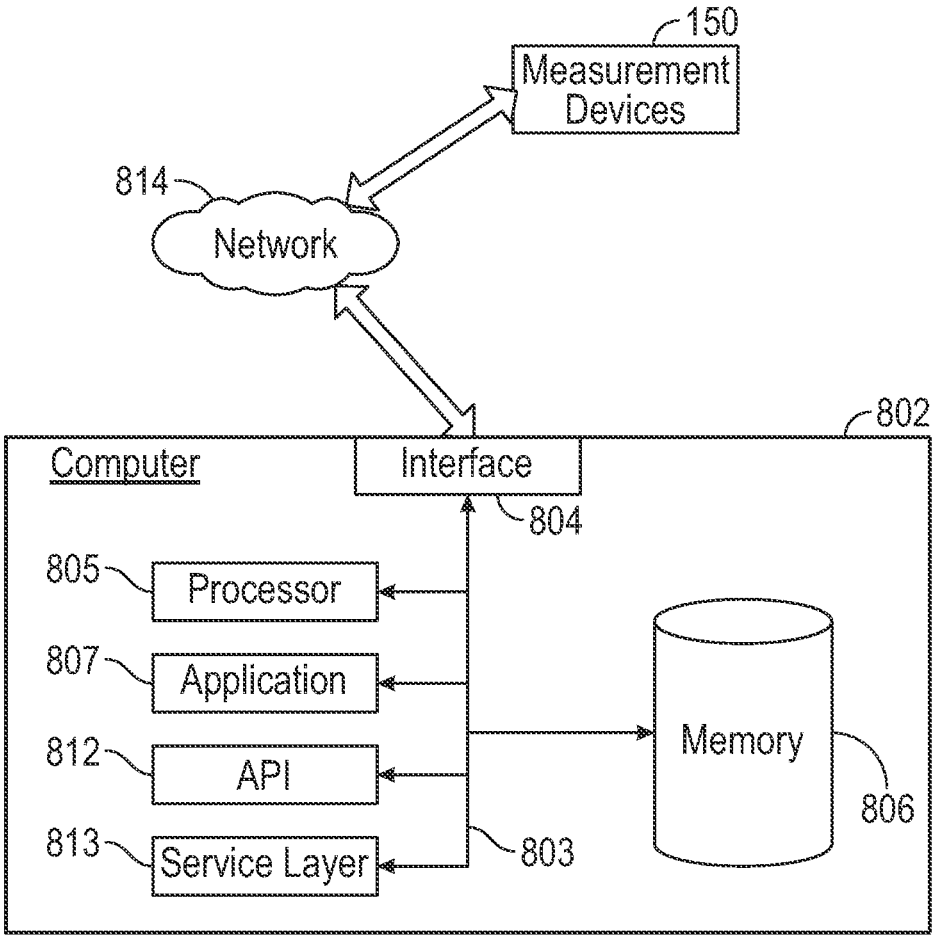
FIG. 4 schematically illustrates a computing device and related components, in accordance with one or more embodiments.

FIG. 4 schematically illustrates a computing device and related components, in accordance with one or more embodiments. As such, FIG. 4 generally depicts a block diagram of a computer system 802 used to provide computational functionalities associated with described algorithms, methods, functions, processes, flows, and procedures as described in this disclosure, according to one or more embodiments. In this respect, computer 802 may interface with one or more measurement devices 150 as described and illustrated with respect to FIG. 1, either directly (e.g., via hard-wired connection) or over an internal or external network 814.

In accordance with one or more embodiments, the illustrated computer 802 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 802 may include a computer that includes an input device, such as a keypad, keyboard, touch screen, or other device that can accept user information, and an output device that conveys information associated with the operation of the computer 802, including digital data, visual, or audio information (or a combination of information), or a GUI.

The computer 802 can serve in a role as a client, network component, a server, a database or other persistency, or any other component (or a combination of roles) of a computer system for performing the subject matter described in the instant disclosure. The illustrated computer 802 is communicably coupled with a network 814. In some implementations, one or more components of the computer 802 may be configured to operate within environments, including cloud-computing-based, local, global, or other environment (or a combination of environments).

At a high level, the computer 802 is an electronic computing device operable to receive, transmit, process, store, or manage data and information associated with the described subject matter. According to some implementations, the computer 802 may also include or be communicably coupled with an application server, e-mail server, web server, caching server, streaming data server, business intelligence (BI) server, or other server (or a combination of servers).

The computer 802 can receive requests over network 814 from a client application (for example, executing on another computer 802) and responding to the received requests by processing the said requests in an appropriate software application. In addition, requests may also be sent to the computer 802 from internal users (for example, from a command console or by other appropriate access method), external or third-parties, other automated applications, as well as any other appropriate entities, individuals, systems, or computers.

Each of the components of the computer 802 can communicate using a system bus 803. In some implementations, any or all of the components of the computer 802, both hardware or software (or a combination of hardware and software), may interface with each other or the interface 804 (or a combination of both) over the system bus 803 using an application programming interface (API) 812 or a service layer 813 (or a combination of the API 812 and service layer 813. The API 812 may include specifications for routines, data structures, and object classes. The API 812 may be either computer-language independent or dependent and refer to a complete interface, a single function, or even a set of APIs. The service layer 813 provides software services to the computer 802 or other components (whether or not illustrated) that are communicably coupled to the computer 802. The functionality of the computer 802 may be accessible for all service consumers using this service layer. Software services, such as those provided by the service layer 813, provide reusable, defined business functionalities through a defined interface. For example, the interface may be software written in JAVA, C++, or other suitable language providing data in extensible markup language (XML) format or another suitable format. While illustrated as an integrated component of the computer 802, alternative implementations may illustrate the API 812 or the service layer 813 as stand-alone components in relation to other components of the computer 802 or other components (whether or not illustrated) that are communicably coupled to the computer 802. Moreover, any or all parts of the API 812 or the service layer 813 may be implemented as child or sub-modules of another software module, enterprise application, or hardware module without departing from the scope of this disclosure.

The computer 802 includes an interface 804. Although illustrated as a single interface 804 in FIG. 4, two or more interfaces 804 may be used according to particular needs, desires, or particular implementations of the computer 802. The interface 804 is used by the computer 802 for communicating with other systems in a distributed environment that are connected to the network 814. Generally, the interface 804 includes logic encoded in software or hardware (or a combination of software and hardware) and operable to communicate with the network 814. More specifically, the interface 804 may include software supporting one or more communication protocols associated with communications such that the network 814 or interface's hardware is operable to communicate physical signals within and outside of the illustrated computer 802.

The computer 802 includes at least one computer processor 805. Although illustrated as a single computer processor 805 in FIG. 4, two or more processors may be used according to particular needs, desires, or particular implementations of the computer 802. Generally, the computer processor 805 executes instructions and manipulates data to perform the operations of the computer 802 and any algorithms, methods, functions, processes, flows, and procedures as described in the instant disclosure.

The computer 802 also includes a memory 806 that holds data for the computer 802 or other components (or a combination of both) that can be connected to the network 814. For example, memory 806 can be a database storing data consistent with this disclosure. Although illustrated as a single memory 806 in FIG. 4, two or more memories may be used according to particular needs, desires, or particular implementations of the computer 802 and the described functionality. While memory 806 is illustrated as an integral component of the computer 802, in alternative implementations, memory 806 can be external to the computer 802.

The application 807 is an algorithmic software engine providing functionality according to particular needs, desires, or particular implementations of the computer 802, particularly with respect to functionality described in this disclosure. For example, application 807 can serve as one or more components, modules, applications, etc. Further, although illustrated as a single application 807, the application 807 may be implemented as multiple applications 807 on the computer 802. In addition, although illustrated as integral to the computer 802, in alternative implementations, the application 807 can be external to the computer 802.

There may be any number of computers 802 associated with, or external to, a computer system containing computer 802, wherein each computer 802 communicates over network 814. Further, the term "client," "user," and other appropriate terminology may be used interchangeably as appropriate without departing from the scope of this disclosure. Moreover, this disclosure contemplates that many users may use one computer 802, or that one user may use multiple computers 802.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method comprising:

attaching hoisting cables to an oil rig mast;

winding the hoisting cables at least in part about hoisting sheaves rotatably mounted on a support;

effecting angular displacement of the mast with the hoisting cables in a process of raising or lowering the mast;

measuring angular displacement of the hoisting sheaves;

comparing measured angular displacement of the hoisting sheaves with one or more reference values; and producing a signal if the measured angular displacement of the hoisting sheaves does not correspond to the one or more reference values.

2. The method according to claim 1, wherein the comparing comprises comparing angular displacement of the hoisting sheaves with at least one predetermined range of reference values.

3. The method according to claim 2, wherein producing a signal comprises producing a signal if the measured angular displacement of the hoisting sheaves lies outside of the at least one predetermined range of reference values.

4. The method according to claim 3, wherein:

the hoisting sheaves comprise two hoisting sheaves; and the measuring comprises separately measuring angular displacement of each of the two hoisting sheaves.

5. The method according to claim 4, wherein the signal is produced if the measured angular displacement of either or both of the hoisting sheaves lies outside of the at least one predetermined range of reference values.

6. The method according to claim 5, further comprising:

measuring an inclination angle of the mast; and tracking the measured angular displacement of the hoisting sheaves against the measured inclination angle.

7. The method according to claim 6, wherein the at least one predetermined range of reference values includes a range of ratios of the angular displacement of the hoisting sheaves to the inclination angle.

8. The method according to claim 5, wherein angular displacement of the hoisting sheaves is measured with laser-based measurement devices.

9. The method according to claim 8, wherein:

the mast is coupled to a substructure via a pivot joint and is rotatable about the pivot joint for the raising or lowering of the mast; and the hoisting cables each include two ends, wherein one end is anchored at the mast and the other end is coupled to a traveling block.

10. A system comprising:

hoisting cables for raising or lowering an oil rig mast;

a support and hoisting sheaves rotatably mounted on the support, wherein the hoisting cables are wound at least in part about the hoisting sheaves during a process of raising or lowering the mast;

measurement devices which measure angular displacement of the hoisting sheaves during a process of raising or lowering the mast with the hoisting cables; and a signaling device which produces a signal if the measured angular displacement of the hoisting sheaves does not correspond to one or more reference values.

11. The system according to claim 10, further comprising a processor for comparing the measured angular displacement of the hoisting sheaves with the one or more reference values.

12. The system according to claim 11, wherein the processor compares the angular displacement of the hoisting sheaves with at least one predetermined range of reference values.

13. The system according to claim 12, wherein the signaling device produces a signal if the measured angular displacement of the hoisting sheaves lies outside of the at least one predetermined range of reference values.

14. The system according to claim 13, wherein:

the hoisting sheaves comprise two hoisting sheaves; and the measurement devices comprise two measurement devices which separately measure angular displacement of each of the two hoisting sheaves.

15. The system according to claim 14, wherein the signaling device produces a signal if the measured angular displacement of either or both of the hoisting sheaves lies outside of the at least one predetermined range of reference values.

16. The system according to claim 15, wherein the processor tracks the measured angular displacement of the hoisting sheaves against a measured inclination angle of the mast.

17. The system according to claim 16, wherein the at least one predetermined range of reference values includes a range of ratios of the angular displacement of the hoisting sheaves to the inclination angle.

18. The system according to claim 17, wherein the measurement devices are laser-based measurement devices.

19. The system according to claim 18, further comprising:

a substructure and a pivot joint which couples the mast to the substructure; and a traveling block;

the mast is being rotatable about the pivot joint for the raising or lowering of the mast; and the hoisting cables each including two ends, wherein one end is anchored at the mast and the other end is coupled to the traveling block.

* * * * *